US006378978B1

(12) United States Patent
Chang et al.

(10) Patent No.: US 6,378,978 B1
(45) Date of Patent: Apr. 30, 2002

(54) CHIP STRUCTURE OF INKJET PRINTHEAD AND METHOD OF ESTIMATING WORKING LIFE THROUGH DETECTION OF DEFECTS

(75) Inventors: Charles C. Chang; Chieh-Wen Wang; Ming-Ling Lee, all of Hsinchu; Jhih-Ping Lu, Hsinchu Hsien; Chen-Yue Cheng, Hsinchu; Yuan-Liang Lan, Hsinchu Hsien, all of (TW)

(73) Assignee: Industrial Technology Research Institute, Hsinchu (TW)

( * ) Notice: Subject to any disclaimer, the term of this patent is extended or adjusted under 35 U.S.C. 154(b) by 119 days.

(21) Appl. No.: 09/630,904

(22) Filed: Aug. 2, 2000

(30) Foreign Application Priority Data

Mar. 15, 2000 (TW) ..... 89104697 A

(51) Int. Cl.[7] ..... B41J 2/01
(52) U.S. Cl. ..... 347/19; 347/58; 347/64
(58) Field of Search ..... 347/19, 50, 56, 347/58, 63, 364

(56) References Cited

U.S. PATENT DOCUMENTS 4,719,477 A * 1/1988 Hess ..... 347/59
5,781,211 A * 7/1998 Bobry ..... 347/58
6,227,657 B1 * 5/2001 Raisanen et al. ..... 347/58

* cited by examiner

*Primary Examiner*—Craig A. Hallacher
(74) *Attorney, Agent, or Firm*—J.C. Patents

(57) ABSTRACT

An inkjet printhead chip structure and a method of estimating the working life through the detection of any defect on the chip structure. The method includes laying a metallic layer such as a tantalum layer over the chip and then shaping the metallic layer into a protective layer circuit. A portion of the metal protective layer covers the heating elements embedded in the chip. In printing, the heating elements heat up the ink to produce jets of ink. However, a portion of the heat is transferred to the metal protective layer thereby raising its temperature. Heat on the metal protective layer combined with any strayed residual ink bubbles that impinge upon the surface of the metal protective layer causes the metal to age. Since resistance of the metal protective layer will increase proportionally to the amount of aging, a measurement of the resistance is capable of estimating how much longer a given chip is suitable for use. Furthermore, if this special circuit layout runs across each long side of an ink slot, any cracks along the direction of the ink slot are detectable during resistance measurement.

12 Claims, 5 Drawing Sheets

CHIP STRUCTURE OF INKJET PRINTHEAD AND METHOD OF ESTIMATING WORKING LIFE THROUGH DETECTION OF DEFECTS

CROSS-REFERENCE TO RELATED APPLICATION

This application claims the priority benefit of Taiwan application serial no. 89104697, filed Mar. 15, 2000.

BACKGROUND OF THE INVENTION

1. Field of Invention

The present invention relates to a method of checking the condition of an inkjet printhead. More particularly, the present invention relates to an inkjet printhead chip structure and a method of estimating the working life through the detection of any defect in the chip structure.

2. Description of Related Art

Inkjet printers are now widely used at home and in the office. The inkjet printhead is an expendable product in printing. In the fabrication of inkjet printhead, the fabrication of the chip is regarded as a front-end process. To obtain a complete printhead, the chip is combined with other components fabricated in the back-end processes. Simple and accurate assessment of the quality of the chip is important because the quality of the inkjet printhead largely depends on the quality of the chip. The production of high-quality printhead is able to reduce cost and unnecessary waste. Two recent trends regarding the use of inkjet printer are the recycling of inkjet printhead and the refilling of empty ink cartridge by the user. Due to such trends, the chip embedded in the inkjet printhead is more likely to be used until the end of its life span. Using such a mode of operation, a method of whenever if necessary, simply and accurately estimating working life of a printhead has great benefits. By the estimation of working life of the printhead, the printhead can be changed in time prior to the actual breakdown of the chip. Therefore, printing waste can be reduced considerably.

The chip embedded inside an inkjet printhead is normally formed using a brittle substance such as silicon. Hence, when the printhead is subsequently processed to form an ink slot, the silicon chip cracks along the direction of the ink slot. In general, the working life of the silicon chip is estimated by the degree of aging of a metal protective layer attached to the inkjet printhead. The metal protective layer will age because small amounts of residual ink bubbles may collapse to the metal surface every time printing is conducted, thereby causing corrosive chemical reactions.

FIG. 1 is a top view showing a conventional an inkjet printhead with a silicon chip thereon. As shown in FIG. 1, the inkjet printhead 100 has a rectangular appearance. A long and narrow ink slot 108 is positioned in the middle of the inkjet printhead 100. The inkjet printhead 100 is divided into two sections along its longitudinal axis. Each section includes a group of conductive lines 102 having a comb shape. A heating element 106 is installed at the junction near the root of the comb teeth. In other words, the heating elements 106 are aligned on each side parallel to the long and narrow ink slot 108. An insulated passivation layer (not shown) covers the heating element 106. On top of it, a metal protective layer 104 is formed over the heating elements 106. The metal protective layer 104 is made from a refractory metal such as tantalum.

According to the inkjet printhead shown in FIG. 1, the circuit on each side of the ink slot 108 is independently insulated. Hence, any crack 110 in the silicon chip running along the direction of the ink slot 108 remains undetected. There are two conventional methods of inspecting the condition of the inkjet printhead 100. One method makes use of an imaging system for detection of cracks in the silicon chip. The other method depends on dismantling the silicon chip from the inkjet printhead 100 to investigate the metal protective layer 104 above the heating elements 106 through a microscope. By observing clues such as color changes in the metal protective layer, the degree of aging of the silicon chip is estimable.

However, the detection of cracks in the silicon chip by an imaging system and the investigation of aging in the silicon chip in a destructive testing are time-consuming and tend to reduce product yield. On the other hand, if defective chips are not singled out in time, defective chips are incorporated into the inkjet printhead resulting in a waste in back-stage processing time. Furthermore, if these defective chips are left undetected so that these inferior quality products are sent to customers, the printing quality of the printers deteriorates much faster than expected, thereby tarnishing the product quality of the manufacturer. Moreover, microscopic investigation of the silicon chip requires dissembling the printhead. Therefore, the investigation is only carried out on a few samples in order to maintain a definite quality level in quality management.

SUMMARY OF THE INVENTION

Accordingly, one object of the present invention is to provide an inkjet printhead chip structure and a method for estimating the working life through the detection of any defect on the chip structure. The method includes laying a circuit over the chip such that resistance of this circuit is measured through contact regions at both ends of the circuit. The circuit is isolated from other working circuits so that operation of the printhead is unaffected. By measuring the resistance of the circuit, cracks on the chip are easily detected.

To achieve these and other advantages and in accordance with the purpose of the invention, as embodied and broadly described herein, the invention provides an inkjet printhead chip structure and a method for estimating the working life through the detection of any defect on the chip structure. The method includes laying a circuit over the chip. The resistance of this circuit is measured through a flexible circuit board. The circuit is isolated from other working circuits so that operation of the printhead is unaffected. By measuring the resistance of the circuit, any cracks on the chip are easily detected. Since a flexible circuit board is used to measure the resistance of the metal protective layer in an inkjet printhead, the measurement is conducted during manufacturing. Furthermore, this method is used to estimate the working life of the used inkjet printhead.

The invention provides an inkjet printhead chip structure and a method for estimating the working life through the detection of any defect on the chip structure. The method includes laying a circuit over the chip. The circuit is a metal protective layer formed over the chip using a material such as tantalum instead of aluminum. A portion of the metal protective layer covers heating elements on the printhead. In normal operations, the heating elements provide the heat necessary for forming high-temperature ink bubbles for printing. However, a portion of the heat is transferred to the metal protective layer on top, thereby raising its temperature. Meanwhile, a portion of residual ink bubbles may collapse onto the surface of the metal protective layer. Heat combined with chemical reaction with the collapsed ink thus ages the metal protective layer. Since resistance of the metal protective layer depends on the amount of aging, the degree of aging is determinable by resistance measurement. Hence, the working life of an inkjet printhead is predictable.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
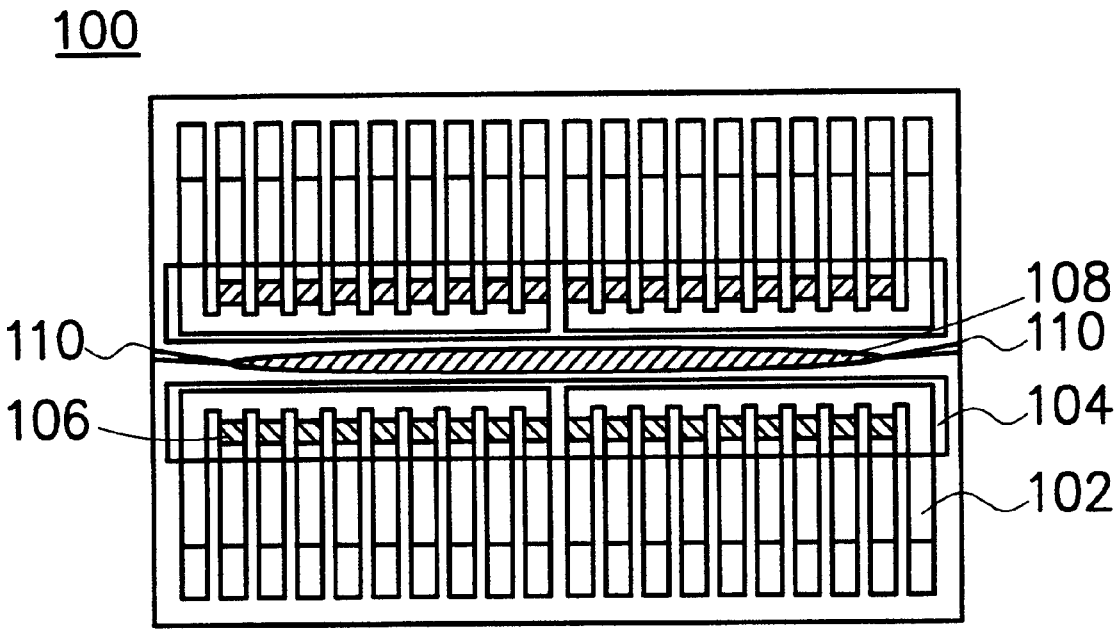
FIG. 1 (PRIOR ART)
FIG. 1 is a top view showing a conventional an inkjet printhead with a silicon chip thereon.

Reference will now be made in detail to the present preferred embodiments of the invention, examples of which are illustrated in the accompanying drawings. Wherever possible, the same reference numbers are used in the drawings and the description to refer to the same or like parts.

Figure 2:
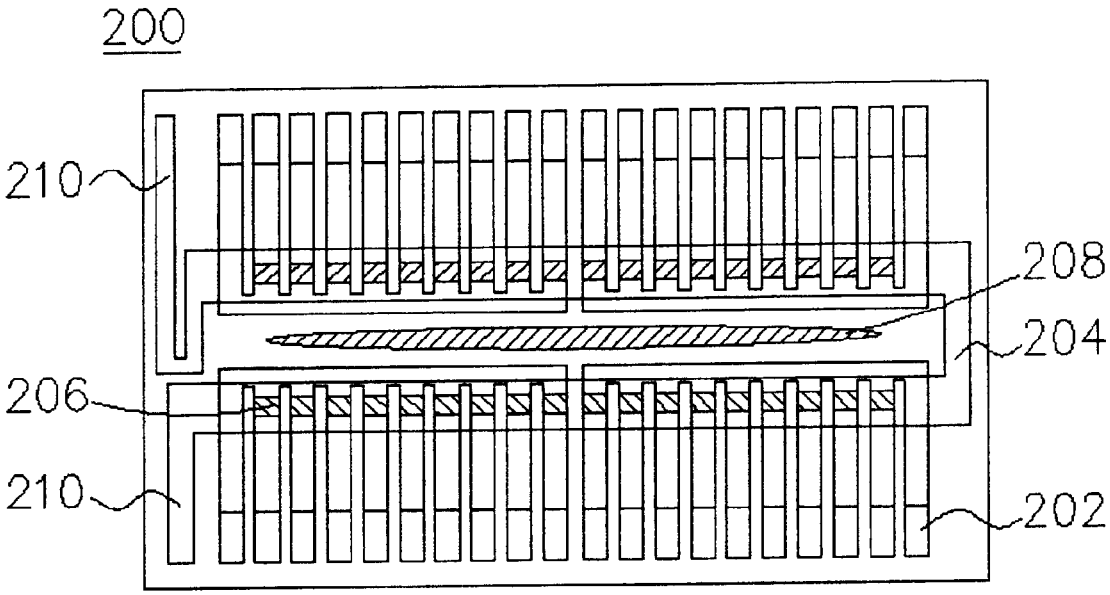
FIG. 2 is a top view of an inkjet printhead having a serially connected metal protective layer over a chip according to one preferred embodiment of this invention.

FIG. 2 is a top view of an inkjet printhead having a serially connected metal protective layer over a chip according to one preferred embodiment of this invention. As shown in FIG. 2, there is a long and narrow ink slot 208 across the center of the inkjet printhead chip 200. The comb-shaped conductive lines 202 are distributed over the surface of the chip 200. The roots of the comb-shaped conductive lines 202 are located on each side of the ink slot 208. Each tooth of the comb-shaped conductive lines 202 extends from the sides of the ink slot 208 to the outer edges of the chip 200. Material for forming the conductive lines 202 includes aluminum. A heating element 206 is formed at the root junction of each comb tooth. Hence, heating elements are aligned parallel to and on each side of the ink slot 208. A portion of a metal protective layer 204 which is on top of the heating elements 206 forms two basically parallel circuit lines outside the long edges of the ink slot 208. Material forming the metal protective layer 204 includes tantalum. The two parallel circuit lines along the long edges of the ink slot 208 are connected together along a short edge of the ink slot 208. Hence, the parallel circuit lines are serially connected together. Two contact regions 210 are formed as extensions from the free ends of the parallel circuit lines along another short edge of the ink slot 208. The contact regions 210 formed by one of the circuit line is positioned along the short edge of the ink slot 208 where these two circuit lines are not connected with each other and is also positioned beside the another parallel circuit line and detours around back to the inner edge of the chip 200. Through such a serially connected metal protective layer 204, any cracks formed at both ends of the ink slot 208 are simultaneously detected. With this arrangement, the metal protective layer 204 has an initial resistance of about 2 Ω to 100 kΩ.

The possible working life of the inkjet printhead chip 200 are estimated by measuring the resistance of the metal protective layer 204. The working life is roughly determined due to resistance of the metal protective layer 204 is proportional to the degree of aging. The metal protective layer 204 may age because a portion of the heat produced by the heating element 206 during printing is transferred to the metal protective layer. Furthermore, residual ink bubbles may also impinge upon the metal protective layer 204 resulting in physical stress and chemical corrosion.

Figure 5:
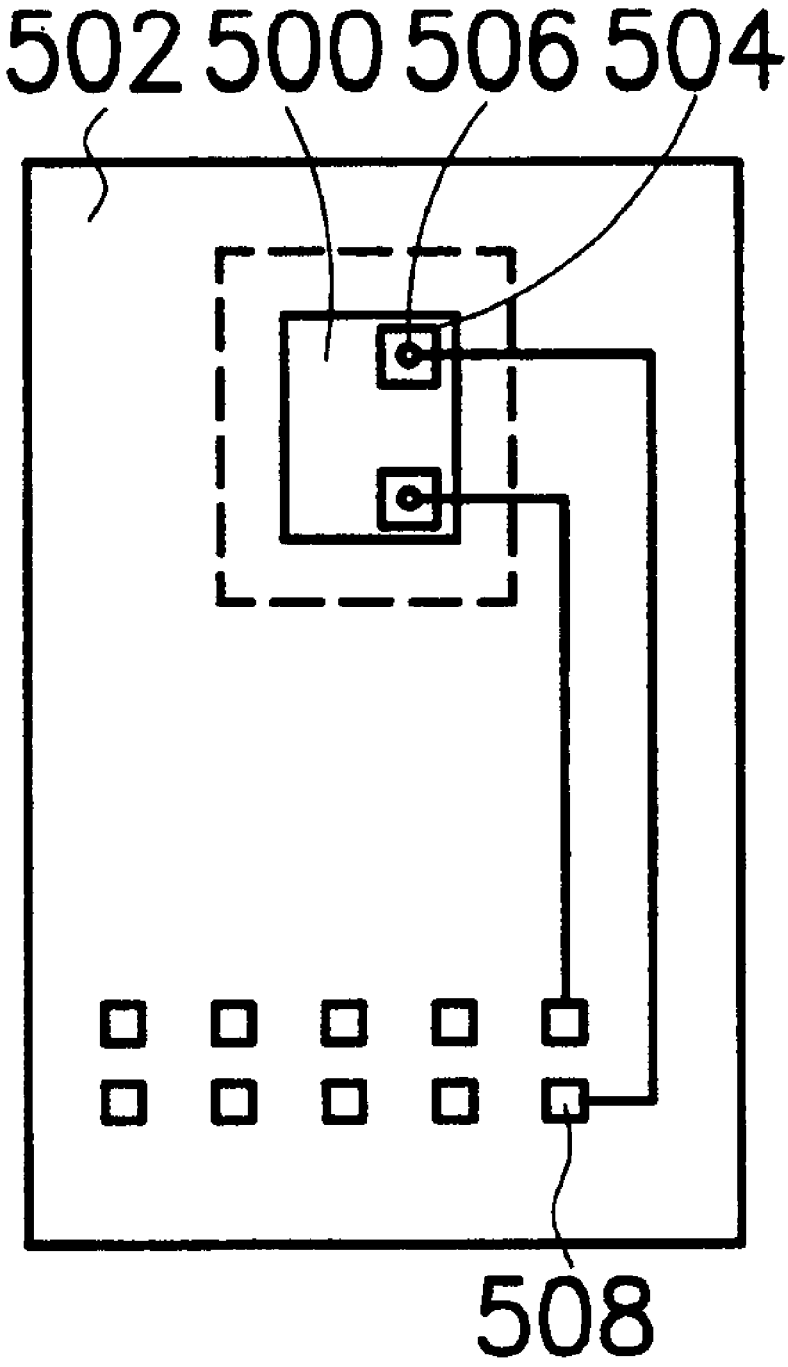
FIG. 5 is a top view of flexible circuit board in the inkjet printhead of this invention for measuring resistance.

FIG. 5 is a top view of flexible circuit board in the inkjet printhead of this invention for measuring resistance. A flexible circuit board 502 and an inkjet printhead chip 500 are aligned such that the leads 506 on the flexible circuit board 502 and the contact regions 504 on the chip 500 are in contact. The leads 506 are electrically connected to probing points 508. In fact, the flexible circuit board 502 has a plurality of probing points 508 and a plurality of leads 506, with each probing point 508 electrically connected to a corresponding lead 506. Hence, the resistance of a metal protective layer is measured by pressing the probing pins of an ohmmeter onto the probing points 508. Sometimes, it is also possible for the probing pins of an ohmmeter to make direct contact with the contact regions 504 on the inkjet printhead chip, without using an intermediate flexible circuit board 502.

Figure 3A:
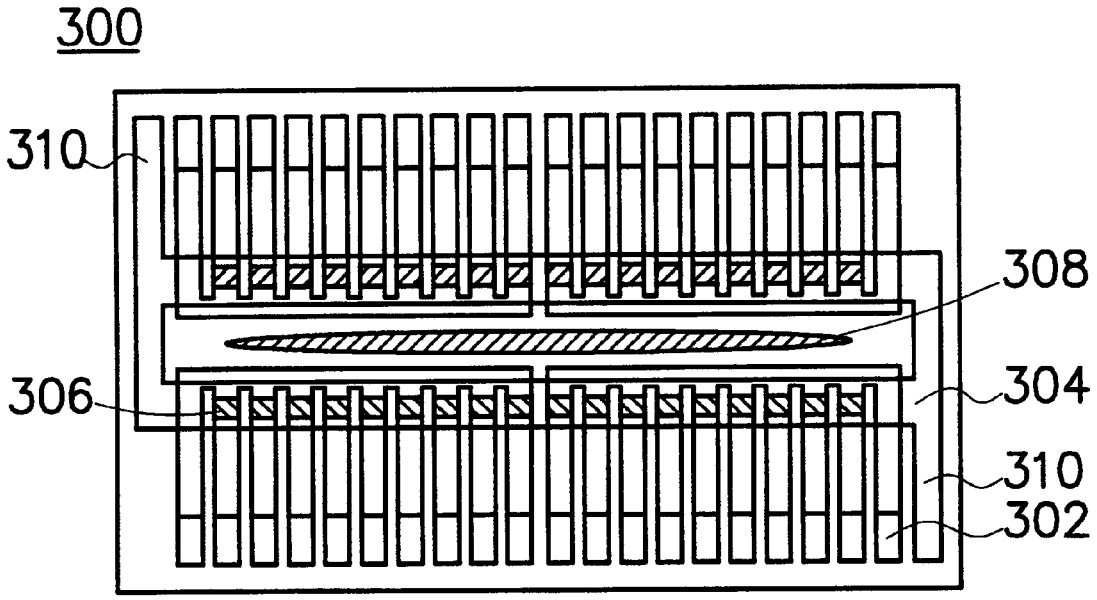
FIGS. 3A and 3B are top views of two inkjet printheads each having a parallelly connected metal protective layer over a chip according to a second embodiment of this invention.
Figure 3B:
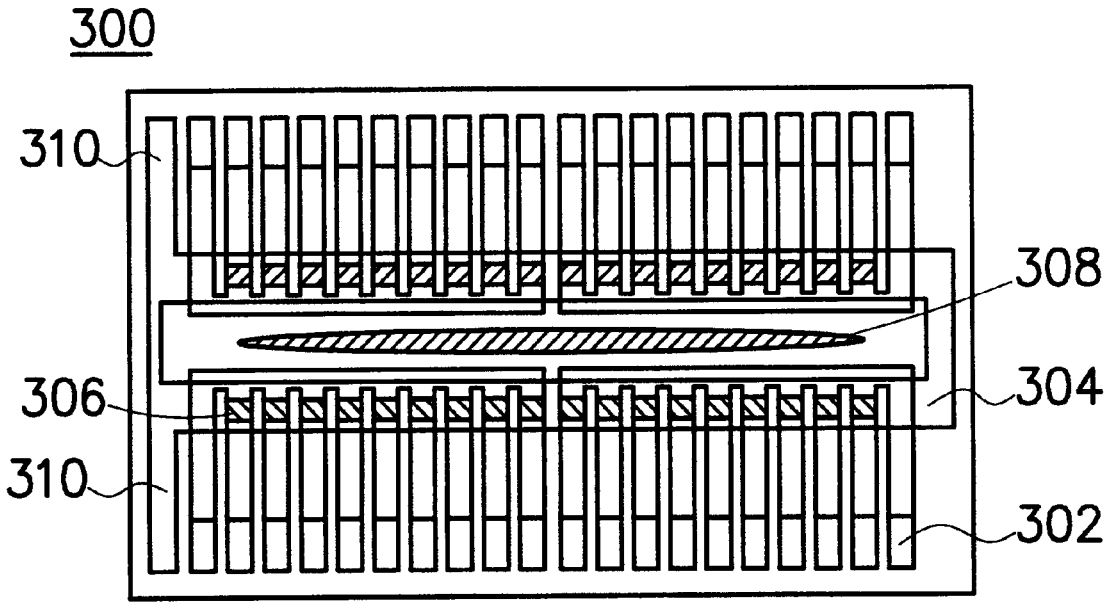

FIGS. 3A and 3B are top views of two inkjet printheads each having a parallelly connected metal protective layer over a chip according to a second embodiment of this invention. As shown in FIGS. 3A and 3B, there is a long and narrow ink slot 308 across the center of the inkjet printhead chip 300. Comb-shaped conductive lines 302 are distributed over the surface of the chip 300. The roots of the comb-shaped conductive lines 302 are next to the ink slot 308. Material for forming the conductive lines 302 includes aluminum. A heating element 306 is formed near the root junction of comb teeth. Hence, heating elements are aligned parallel to and on each side of the ink slot 308. Each branch of the comb-shaped conductive lines 302 extends from the sides of the ink slot 208 to the outer edges of the chip 300. A portion of the metal protective layer 304 covers the heating elements 306, thereby forming two basically parallel circuit lines outside the long edges of the ink slot 308. Material forming the metal protective layer 304 includes tantalum. The two parallel circuit lines along the long edges of the ink slot 308 are connected parallelly by two short circuit lines along the short edges of the ink slot 308. Hence, the parallel circuit lines are connected parallelly forming a rectangular-shaped protective layer circuit. Finally, two contact regions 310 are formed extending from the parallel circuit lines. With this arrangement, the metal protective layer 304 will have an initial resistance of about 2 Ω to 100 kΩ.

Note that the two contact regions 310 of the metal protective layer 304 emerge from the opposite sides of the chip 300 in FIG. 3A. On the other hand, the two contact regions 310 of the metal protective layer 304 emerge from the same side of the chip 300 in FIG. 3B.

The parallel circuit lines of the metal protective layer 304 on each side of the ink slot 308 are connected parallelly.

Hence, cracks that form on the chip are detected by measuring the resistance of the metal protective layer 304. Similar to the one in the first embodiment, the metal protective layer 304 will age according to the frequency of use in printing. By measuring the resistance and comparing with the initial value, the working life of the chip is roughly estimated. The metal protective layer 304 may age because a portion of the heat produced by the heating element 306 during printing is transferred to the metal protective layer. Furthermore, residual ink bubbles may also impinge upon the metal protective layer 304, resulting in physical stress and chemical corrosion.

The method of measuring the resistance of the metal protective layer 304 is similar to the method used in the first embodiment and illustrated in FIG. 5. Hence, a detailed description is omitted here.

Figure 4A:
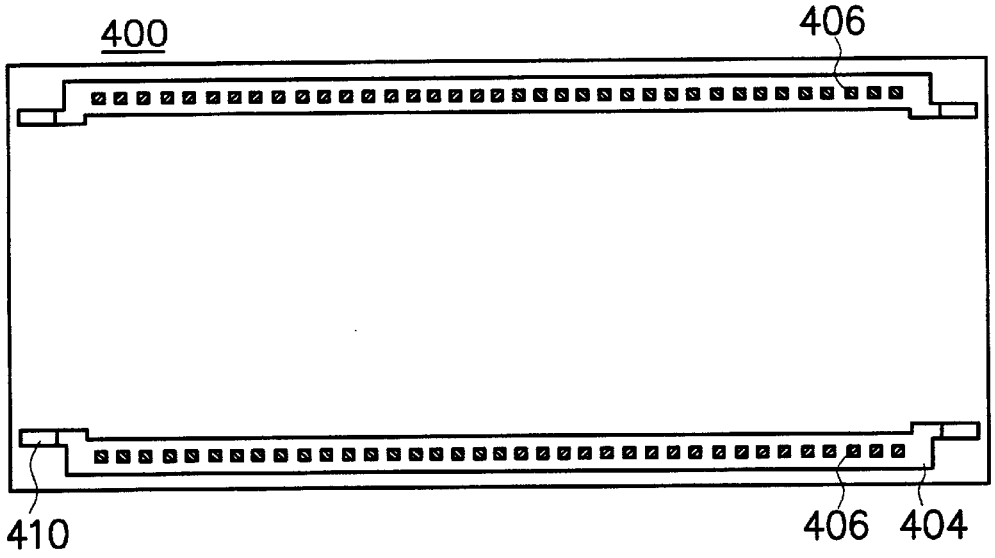
FIGS. 4A and 4B are top views of two inkjet printheads each having a metal protective layer over a chip according to a third embodiment of this invention.
Figure 4B:
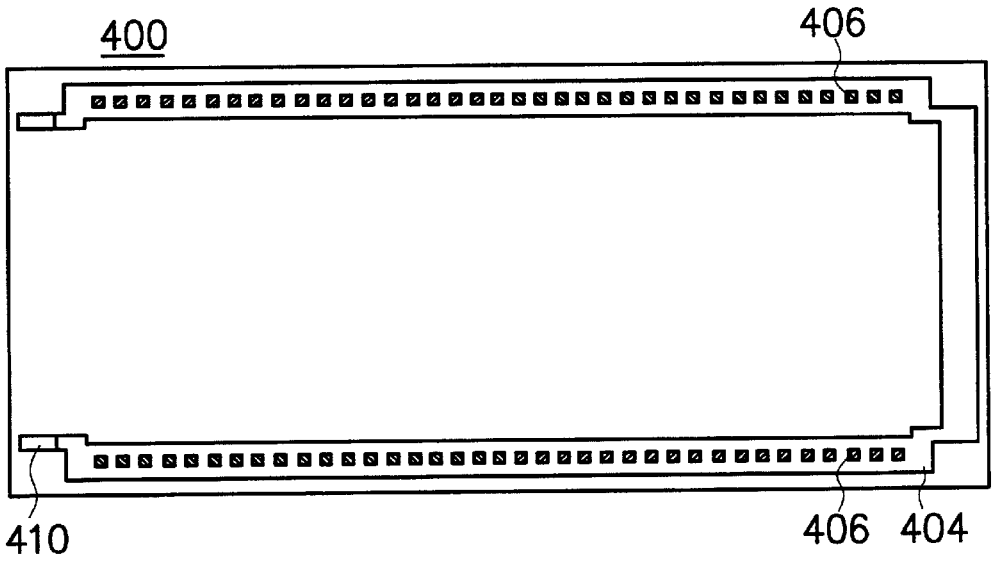

FIGS. 4A and 4B are top views of two inkjet printheads each having a metal protective layer over a chip according to a third embodiment of this invention. As shown in FIG. 4A, heating elements 406 are distributed along the two long sides of a rectangular inkjet printhead chip 400. A portion of the metal protective layer 404 covers the heating elements 406 forming two parallel circuit lines along the two long sides of the rectangular chip 400. Contact regions 410 are attached to the ends of the parallel circuit lines. With such a configuration, the metal protective layer 304 has an initial resistance of about 2 Ω to 100 kΩ.

In FIG. 4B, heating elements 406 are distributed along the two long sides of a rectangular inkjet printhead chip 400. A portion of the metal protective layer 404 covers the heating elements 406 forming two parallel circuit lines along the two long sides of the rectangular chip 400. The two parallel circuit lines are serially connected through a shorter circuit line at one side. Contact regions 410 are attached to the free ends of the parallel circuit lines. With such a configuration, the metal protective layer 304 has an initial resistance of about 2 Ω to 100 kΩ.

Because this type of inkjet printhead supplies ink from the sides, there is no need for an ink slot on the chip. Consequently, the problem caused by the chip cracking along the ink slot direction is non-existent. However, the metal protective layer 404 still ages with frequent use. By measuring the resistance of the metal protective layer 404 and comparing with the initial resistance, how much longer a given inkjet printhead is suitable for use is estimable.

The method of measuring the resistance of the metal protective layer 404 is similar to the method used in the first embodiment and illustrated in FIG. 5. Hence, a detailed description is omitted here.

Since the heating elements continue to supply necessary heat for printing, temperature of the metal protective layer above the heating elements will gradually rise. Meanwhile, some of the residual ink bubbles may stray onto the heated surface of the metal protective layer causing some physical stress and chemical reaction. Hence, the metal protective layer may age resulting in a higher electrical resistance. By measuring the increase in electrical resistance in the metal protective layer, the degree of aging is thus gauged. In this invention, since a flexible circuit board is used to measure the resistance of the metal protective layer in an inkjet printhead, the measurement is conducted during manufacturing. Furthermore, the method is used to estimate the working life of the used inkjet printhead.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An inkjet printhead chip structure, comprising:

at least one ink slot across the middle of the chip;

a plurality of conductive lines distributed on each side of the ink slot;

a plurality of heating elements embedded under the conductive lines positioned substantially parallel to the long sides of the ink slot; and a serial-connected metal protective circuit that covers a portion of the heating elements, wherein the conductive lines on one side of the ink slot and the conductive lines on the other side of the ink slot are serially connected by a shorter conductive line near the edge of the chip to form the metal protective circuit, wherein the metal protective circuit has extension regions for connecting to external circuits.

2. The structure of claim 1, wherein the metal protective circuits has an initial resistance of about 2 Ω to 100 kΩ.

3. An inkjet printhead chip structure, comprising:

at least one ink slot across the middle of the chip;

a plurality of conductive lines distributed on each side of the ink slot;

a plurality of heating elements embedded under the conductive lines positioned substantially parallel to the long sides of the ink slot; and a parallel-connected metal protective circuit that covers a portion of the heating elements, wherein the conductive lines on one side of the ink slot and the conductive lines on the other side of the ink slot are paralleled connected by two shorter conductive lines near the edges of the chip to form the metal protective circuit, wherein the metal protective circuit has extension regions for connecting to external circuits.

4. The structure of claim 3, wherein the metal protective circuits has an initial resistance of about 2 Ω to 100 kΩ.

5. An inkjet printhead chip structure, comprising:

a plurality of heating elements distributed close to the long edges of the chip; and a plurality of metal protective circuits over the heating elements, wherein the metal protective circuits cover the heating elements on each side of the chip and the circuit on each side of the chip has extension regions for connecting to external circuits.

6. The structure of claim 5, wherein the metal protective circuits has an initial resistance of about 2 Ω to 100 kΩ.

7. An inkjet printhead chip structure, comprising:

a plurality of heating elements distributed close to the long edges of the chip; and a metal protective circuit over the heating elements, wherein the metal protective circuit includes separate parallel metal protective circuits that cover the heating elements on each side of the chip and then joined together by a short conductive line near the short edge of the chip, and the metal protective circuit has extension regions for connecting with external circuits.

8. The structure of claim 7, wherein the metal protective circuits has an initial resistance of about 2 Ω to 100 kΩ.

9. A method for determining the working life of an inkjet printhead chip having a metal protective circuit over the chip with a few extension regions for connecting to external circuits, comprising:

measuring the resistance of the metal protective circuit using an ohmmeter by contacting the metal protective circuit via the extension region; and determining the degree of aging of the material constituting the metal protective circuit according to the value of the resistance.

10. A method for determining the working life of an inkjet printhead chip having a metal protective circuit over the chip with a few extension regions for connecting to external circuits, comprising:

measuring the resistance of the metal protective circuit using an ohmmeter by contacting the metal protective circuit via the extension region; and finding any breakage along the metal protective circuit according to the value of the resistance.

11. A method for determining the working life of an inkjet printhead chip having a metal protective circuit over the chip with a few extension regions for connecting to external circuits, comprising:

providing a flexible circuit board, wherein the flexible circuit board has a plurality of probing points and a plurality of leads thereon, each probing point is electrically connected to a corresponding lead, and each lead correspond in position to an extension region of the metal protection circuit so that the leads and the extension regions are in contact with each other;

measuring the resistance of the metal protective circuit using an ohmmeter by pressing the probing points on the flexible circuit board; and determining the degree of aging of the material constituting the metal protective circuit according to the value of the resistance.

12. A method for determining the working life of an inkjet printhead chip having a metal protective circuit over the chip with a few extension regions for connecting to external circuits, comprising the steps of:

providing a flexible circuit board, wherein the flexible circuit board has a plurality of probing points and a plurality of leads thereon, each probing point is electrically connected to a corresponding lead, and each lead correspond in position to an extension region of the metal protection circuit so that the leads and the extension region are in contact with each other;

measuring the resistance of the metal protective circuit using an ohmmeter by pressing the probing points on the flexible circuit board; and finding any breakage along the metal protective circuit according to the value of the resistance.

* * * * *